US006012530A

United States Patent [19]

Korsgaard

[11] Patent Number: 6,012,530

[45] **Date of Patent: *Jan. 11, 2000**

[54] METHOD AND APPARATUS FOR PRODUCING AND SHIPPING HYDROCARBONS OFFSHORE

[76] Inventor: Jens Korsgaard, 318 N. Post Rd., Princeton Junction, N.J. 08550

[ * ] Notice: This patent is subject to a terminal disclaimer.

[21] Appl. No.: 08/784,871

[22] Filed: Jan. 16, 1997

[51] Int. Cl.[7] ..... E21B 43/01

[52] U.S. Cl. ..... 166/352

[58] Field of Search ..... ; E21B 43/01

[56] References Cited

U.S. PATENT DOCUMENTS

| | | | |
|---|---|---|---|
| 2,381,396 | 8/1945 | Kuhn . | |
| 3,145,680 | 8/1964 | Farkas et al. . | |
| 3,311,063 | 3/1967 | Grable | 166/352 |
| 3,556,218 | 1/1971 | Talley, Jr. et al. | 166/357 |
| 3,590,407 | 7/1971 | Bratianu et al. . | |
| 3,602,302 | 8/1971 | Kluth | 166/352 |
| 3,705,626 | 12/1972 | Glenn, Jr. et al. . | |
| 3,782,458 | 1/1974 | Slack | 141/387 |
| 4,083,318 | 4/1978 | Verolme . | |
| 4,113,132 | 9/1978 | Steiner . | |
| 4,242,528 | 12/1980 | Hubbard et al. . | |
| 4,301,840 | 11/1981 | Jansen . | |
| 4,310,263 | 1/1982 | Daughtry | 166/347 |
| 4,375,835 | 3/1983 | Archer | 166/357 |
| 4,446,804 | 5/1984 | Kristiansen et al. . | |
| 4,448,568 | 5/1984 | Gentry et al. | 166/345 |
| 5,199,266 | 4/1993 | Johansen . | |
| 5,256,171 | 10/1993 | Payne . | |
| 5,477,924 | 12/1995 | Pollack . | |
| 5,697,732 | 12/1997 | Sigmundstad | 166/345 |

*Primary Examiner*—Hoang Dang
*Attorney, Agent, or Firm*—Kenyon & Kenyon

[57] ABSTRACT

A method and apparatus for off-shore production of oil. Special shuttle tankers with high-pressure cargo tanks capable of containing the produced live crude oil at a pressure close to that of the ambient pressure inside a subterranean oil field, and without any processing of the live crude oil prior to transportation are used. The produced live crude oil from the subterranean oil field is pumped directly into the high-pressure cargo tanks aboard the shuttle tanker. Lighter fractions of the live crude oil stored in the shuttle tanker may be used as a fuel to power the propulsion machinery and the auxiliary machinery aboard the shuttle tanker. The pressures in the tanks are ordinarily above 70 kPa gauge pressure, may be higher than 1.8 MPa gauge, and may range as high as 35 MPa gauge or even higher. The tanker vessel transports the produced live crude oil to an onshore processing plant for separation into gas, water, solids, and stabilized crude oil.

11 Claims, 3 Drawing Sheets

METHOD AND APPARATUS FOR PRODUCING AND SHIPPING HYDROCARBONS OFFSHORE

BACKGROUND OF THE INVENTION

1. Field of the Invention

The present invention relates to a method and apparatus for producing and shipping hydrocarbons, e.g., crude oil, from an offshore site. In particular, the present invention relates to a method and apparatus which does not require an offshore processing plant and which allows both gas and oil to be shipped to an onshore processing plant.

2. Description of the Prior Art

Crude oil and natural gas from offshore wells is produced in the following manner according to the teachings of the presently-known prior art technology. First, the crude oil and gas wells are drilled and completed using drilling equipment that is mounted on either a jack-up drilling rig or on a floating vessel.

After the wells have been drilled and completed they are typically connected to an offshore processing plant that separates the live crude oil from the well—which is typically a mixture of oil, gas, water, salt and other solids—into a stabilized crude oil with a low vapor pressure—that is therefore suitable for transportation in ordinary tanker vessels—and a natural gas component—that is suitable for transportation onshore by a pipeline. Ordinarily, the stabilized crude oil is processed at the offshore processing plant sufficiently so that it may be used in a standard onshore refining process without further treatment to remove solids, salt, and water from the crude oil. Therefore, the offshore processing facility also removes water, salt and other solids from the live crude oil before it is transferred to the vessel as stabilized crude oil.

The stabilized crude oil may then be transported ashore by pipeline or by tanker vessels, which tanker vessels normally store the stabilized crude oil at or near atmospheric pressure. The produced gas is ordinarily transported ashore in pipelines. In addition to transporting the produced gas ashore by pipeline, a number of emerging technologies exist to transport the gas in ships, by subjecting the gas to chemical processes that convert it, for example, into methanol or by liquefying the gas and transporting it as a cooled liquid. The technologies for transporting the gas in ships all require large capital expenditures and cause the loss of a significant fraction of the energy content in the gas during processing and transportation.

If tanker transportation of the stabilized crude oil is used from the offshore oil field processing plant, significant hydrocarbon losses usually occur due to de-gassing of the crude oil in the cargo tanks. The economics and safety of ordinary tanker transportation do not permit the re-capture and retention of this gas, leading to the waste of this energy source.

In the event that no pipeline is available to transport the gas ashore, because of, e.g., distance, many jurisdictions today require that the gas be re-injected into the hydrocarbon-bearing soil formation to preserve the gas for future production when the economics of exploitation permits the production and transportation of the gas. At locations where re-injection requirements do not exist, the gas may be burned in a flare. Either of these processes, re-injection or flaring, are expensive and waste energy that could otherwise be produced or used.

The offshore processing plant of the presently-known prior art technology may be mounted on a platform sitting on the sea bed, on a ship-like vessel, on a semi-submersible, or on a tension leg platform. Other possible means of mounting offshore processing plants also exist. However, all of these means have in common the fact that the platform for supporting the processing plant is very expensive.

The offshore processing plant of the presently-known prior art technology is expensive compared to a comparable crude oil processing plant on land, because the offshore processing plant must be specially adapted for the offshore environment, for operation in a restricted space, to compensate for possible movement and accelerations of the plant during operations and, and for limited possibilities for maintenance. Furthermore, the crew operating the offshore plant is regularly ferried back and forth between the platform and land, and all their needs, with the possible exception of fuel, must also be ferried to the plant from shore.

Thus, the capital costs and the operating costs for an offshore processing plant of the presently-known technology is much higher than for a corresponding plant on land.

SUMMARY OF THE INVENTION

The object of the present invention is to overcome some or all of the drawbacks associated with the present technology. This object is achieved by constructing special shuttle tankers with high-pressure cargo tanks capable of containing the produced live crude oil (i.e., crude oil which has not been stabilized by removal of mixed gas, or further processed to remove water, salt or other solids) at a pressure close to that of the ambient pressure inside the subterranean oil field, and without any processing of the live crude oil prior to transportation. The produced live crude oil from the subterranean oil field is pumped directly into the high-pressure cargo tanks aboard the shuttle tanker. Re-injection or flaring of produced gas mixed with the crude oil is avoided or greatly reduced, and escape of the lighter fractions of the crude oil to the atmosphere is prevented.

In the practice of this invention it is the intent to use the lighter fractions, such as methane, of the produced live crude oil stored in the shuttle tanker as a fuel to power the propulsion machinery and the auxiliary machinery aboard the shuttle tanker. This action lowers the pressure of the contained live crude oil. The ambient temperature of the live crude oil in the ground is ordinarily significantly higher than the ambient temperature at the sea surface. During the production process the produced live crude oil is cooled, as the result of transfer of the live crude oil from the well, through the riser and into the vessel, with a consequent reduction in vapor pressure of the live crude oil.

The pressures at which the cargo must be contained in order to contain most of the lighter fractions of the produced live crude oil in liquid form vary greatly from oil field to oil field. However, the pressures would ordinarily be above 70 kPa gauge pressure, may be higher than 1.8 MPa gauge, and may range as high as 35 MPa gauge or even higher. Standard shuttle tankers of the prior art can only accept a pressure differential of approximately 25 kPa between the interior of the cargo tanks and the exterior atmosphere, i.e., a pressure of 25 kPa gauge. Therefore, tanks in ordinary tankers of the prior art must be vented to the atmosphere to prevent dangerous differential pressures from building within the cargo tank as gas dissociates from the stabilized crude oil because of the vapor pressure increase as the result of storing the stabilized crude oil at or near atmospheric. This venting in the prior art causes significant energy loss, which loss is eliminated or greatly reduced using the method and apparatus of the present invention.

Application of the present invention requires that the tanker vessel transport the produced live crude oil to an onshore processing plant for separation into gas, water, solids, and stabilized crude oil. This plant may be situated anywhere that the tanker vessel can go that is advantageously situated relative close to customers of the oil and the gas.

The above and other features and advantages of the oil production method and apparatus are described in detail below in connection with the drawings.

DETAILED DESCRIPTION OF THE INVENTION

Figure 1:
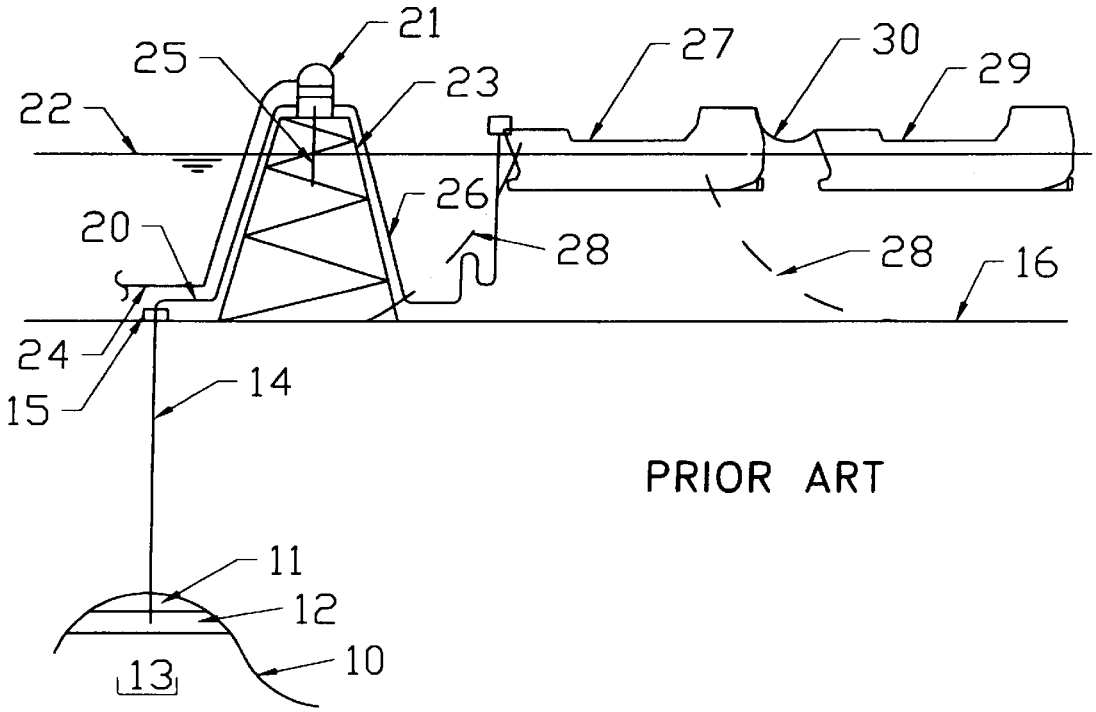
FIG. 1 is diagram representing the existing technology of offshore oil production.

FIG. 1 illustrates an example of the production of oil in accordance with the present technology.

An underground sub-sea hydrocarbon reservoir 10 may include a gas layer 11, an oil layer 12, and a water layer 13. The reservoir 10 is tapped through a well 14. The well 14 terminates in a wellhead 15 at the sea bed 16. A crude-oil/water/gas mixture (which mixture may also contain salt and other solids), also known as live crude oil, flows from the well head 15 through the pipe 20 to a processing plant 21 elevated above the sea surface 22 by a platform 23. The processing plant 21 separates the live crude oil into a gas that is conveyed to shore by the pipeline 24, produced water that is discharged to the sea through pipe 25, and stabilized crude oil that is transferred through a pipe 26 to a floating storage vessel 27. Stabilized crude oil is crude oil which has had, inter alia, volatile gas removed from it by the processing plant 21.

The storage vessel 27 is permanently moored near the platform 23 by anchor lines 28 connected to sea bed anchors (not shown), and stores the stabilized crude oil produced by the processing plant 21 at approximately atmospheric pressure or at a pressure no greater than 25 kPa gauge. The crude oil is transported away from the storage tanker 27 by shuttle tankers 29 that receive the oil through a cargo transfer hose 30. Shuttle tankers 29 also store the stabilized crude oil at approximately atmospheric pressure or at a pressure no greater than 25 kPa gauge.

Figure 2:
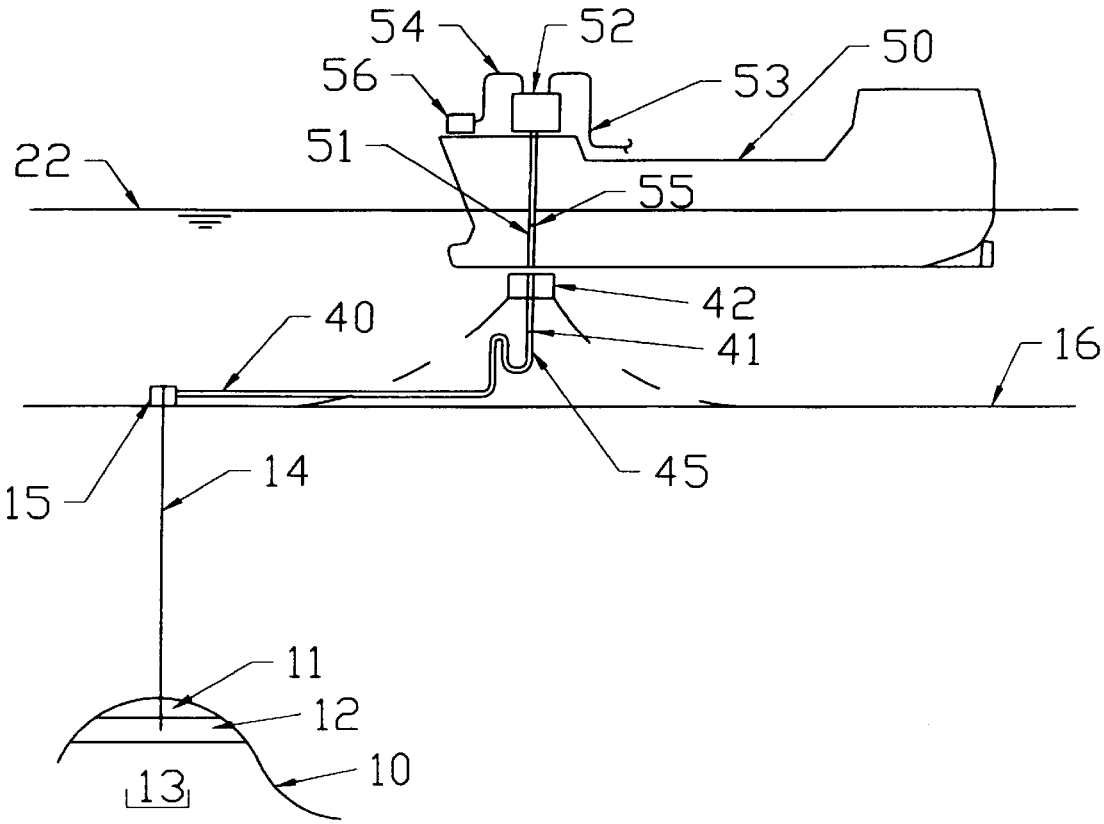
FIG. 2 is a diagram describing offshore oil production in accordance with the present invention.

FIG. 2 shows an oil production system in accordance with the teachings of the present invention. A sub-sea hydrocarbon reservoir 10 comprises a gas layer 11, an oil layer 12, and a water layer 13. The reservoir 10 is tapped by the well 14 terminating in a sub-sea wellhead 15. The wellhead 15 may be located at the sea-bed 16 or above or below the seabed 16 as circumstances may dictate. The wellhead 15 is connected through a pipeline 40 to a riser 41 terminating in a mooring buoy 42 for the shuttle tanker 50. Mooring buoy 42 may for example be of the type shown in U.S. Pat. Nos. 4,262,380; 4,490,121; 5,240,446; 5,305,703; or 5,515,803. The live crude oil is conveyed through the mooring buoy 42 by piping (not shown) in the mooring buoy 42 to piping 51 in the shuttle tanker 50, through a multi-path swivel 52, and to cargo piping 53 aboard the tanker 50. The tanker 50 is a special tanker adapted to store the produced crude oil at a pressure at or somewhat below the pressure in the sub-sea oil field 10.

In the event that the oil field 10 is located in an area with a very benign environment, the shuttle tanker may moored in a manner that it cannot weather vane. In this case the multi-path fluid swivel 52 may be eliminated. Although the multi-path fluid swivel 52 is shown mounted in the vessel 50, it could also be mounted in the buoy 42.

The well head 15 may include instrumentation and controls (not shown) in order to monitor the flow from the well and in order to be able to shut in the well. The instrumentation and the controls (not shown) at the well head 15 are connected to the vessel 50 by an umbilical 45 connected to control and instrument cabling 55 aboard the vessel 50. The cabling 55 is connected through the multi-path swivel 52 to fixed cabling 54 to control and monitoring systems 56 aboard the vessel 50.

The riser 41, submarine pipeline 40, and umbilical 45 may consist of multiple individual units connecting to a number of different wellheads 15. Each of the risers 41 and umbilicals 45 may connect to multiple pipes 53 and multiple cabling 54 aboard the vessel. The multi-path swivel 52 in such a case would be equipped with sufficient fluid, instrument, and control paths (not shown) to service all risers 41 and umbilicals 45 individually. The umbilical 45 may also contain electrical or hydraulic power conduits (not shown) to power subsea pumping equipment (not shown) to boost the flow in the well 14.

Some of the wells 14 may serve as water injection wells 91 or as gas injection wells 93 (see FIG. 3) being supplied with water and gas, respectively, from the vessel 50. While it is usually advantageous to avoid gas injection wells 93 when producing the crude oil using the technology taught in the present invention, all standard well production and stimulation schemes may be employed, provided the vessel 50 is fitted with the required equipment.

Figure 3:
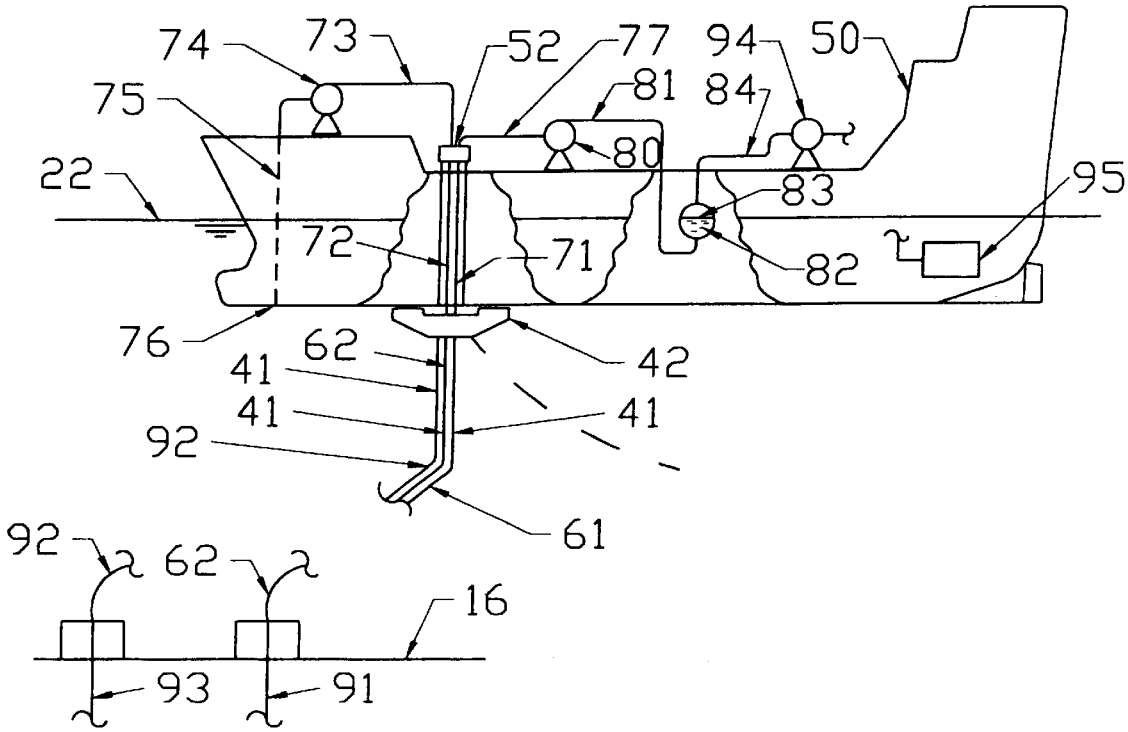
FIG. 3 is side view of a vessel adapted for the production of offshore oil in accordance with the present invention.

FIG. 3 shows in more detail the vessel 50. In this figure the control, power, and instrumentation equipment 56, 54, 55, and 45 have been omitted for clarity.

Three risers 41 are shown, one 61 is connected to an oil producing well (not shown), one 62 is connected to a water injection well 91, and one 92 is connected to a gas injection well 93. It is to be understood that water injection well 91, water injection riser 62, gas injection well 93 and gas injection riser 92 are all optional features, and are only needed where local geological conditions or local regulations require that water or gas be re-injected into reservoir 10. Water for water injection is drawn from the sea at intake 76 and conveyed to the pump 74 through suction piping 75. The pump 74 has a discharge pressure sufficient to overcome the flow pressure losses in the well and the pressure in the oil field itself. The water is conveyed through the discharge pipe 73, through the multi-path fluid swivel 52, and into connector pipe 72. The connector pipe 72 is connected to internal piping (not shown) in mooring buoy 42 and then to the riser 62, and thereafter into the water injection well 91.

The produced crude-oil/water/gas mixture or live crude oil is received through riser 61 then through piping in the mooring buoy 42 (not shown) to connector pipe 71. The produced fluids are then conveyed through the multi-path swivel 52 to suction pipe 77 for pump 80. Pump 80 raises the pressure in the produced fluid sufficient so that the dissociation of gases in the crude oil stops or slows down significantly. The produced fluid is then conveyed through pipe 81 to the high pressure storage tank 82. Storage tank 82 is normally spherical or cylindrical. The vessel is usually equipped with a large number of tanks 82, but only one is shown in FIG. 3, for clarity. The produced fluid stored in tanks 82 will typically dissociate into a gas phase and fluid phase, separated by a surface 83 within the tank 82. The gas phase may be drawn off through the pipe 84 for use as fuel for powering the propulsion system 95 of tanker 50 or for other purposes aboard the tanker 50. As an alternative, the gas phase may also be drawn off, pressurized by a gas pump 94, conveyed by piping (not shown) to the multi-path fluid swivel 52, into a connector pipe (not shown) connected to internal piping (not shown) in mooring buoy 42, then conveyed to a gas injection riser 92 connected to the internal piping in the mooring buoy 42, and thereafter into a gas injection well 93.

Storage tanks 82, in order to limit the dissociation of gases in the crude oil and to safely handle and transport the crude-oil/water/gas mixture, must be designed to maintain the crude-oil/water/gas mixture at a pressure approximating that in the formation 10. The storage tanks 82 must therefore be capable of holding pressures of above 70 kPa gauge pressure, pressures which may be in excess of 1.8 MPa gauge, and pressures possibly as high as 35 MPa gauge. One tank design which will hold pressures in this range and which will also comply with maritime and other safety regulations is disclosed in my provisional patent application filed concurrently herewith.

In the event that produced water settles out in tank 82 it may be withdrawn through piping (not shown) and conveyed to pump 74 for re-injection into the formation 10, through water injection riser 62 and water injection well 91.

Operation of the device of the present invention is as follows. First, one or more crude oil and gas wells 14 are drilled and completed using drilling equipment that is mounted on either a jack-up drilling rig or on a floating vessel (not shown). Thereafter, each drilled well is capped with a suitable wellhead 15. Wellheads 15 may include or be connected to subsea pumping equipment (not shown) which boosts the flow in the well, instrumentation and control equipment (not shown) which monitors the flow from the well and may shut off the flow from the well. Riser 41, which may contain one or more risers 41 and umbilicals 45, is then connected to the wellheads 15, which riser 41 is then connected to a mooring buoy 42, which mooring buoy 42 is anchored to the sea bed in a known fashion.

When it is desired to retrieve and transport live crude oil from the wells 14, vessel 50 steered over the mooring buoy 42 and thereafter attached to the mooring buoy in a known manner. Cabling 54 and piping 53 on the vessel is connected to the umbilicals 45 and risers 41 by connection of piping 51 and cabling 55, connected to the swivel connection 52 on the vessel 50, with piping and cabling (not shown) in the mooring buoy 42, connected to risers 41 and umbilicals 45. Control and monitoring systems 56 on vessel 50 are then activated to send a signal, through cabling 54 and umbilicals 45, to open the flow of fluids from the wells 14 and/or to pump fluids from the wells 14. The live crude oil flowing from wells 14 flows through risers 61, through mooring buoy 42, through connector pipe 71 and suction pipe 77. The live crude oil is thereafter pressurized by pump 80 so that it flows into tanks 82, through pipe 81, and is thereafter stored in tanks 82 at a pressure approximately equal to that at which the live crude oil was kept in the reservoir 10, i.e., pressures of above 70 kPa gauge, pressures which may be in excess of 1.8 MPa gauge, and pressures possibly as high as 35 MPa gauge. During the time when the vessel 50 is connected to mooring buoy 42, seawater may be pumped by pump 74 through intake 76, discharge pipe 73, riser 62 and into water injection well 91, if local conditions or regulations require water re-injection into the reservoir 10. Additionally, or alternatively, water which settles out in tanks 82 may be pumped by pump 74 into water injection well 91. Additionally, if local conditions or regulations require gas re-injection into the reservoir 10, gas in tanks 82 may be pumped by pump 94 through pipe 84, through riser 92 and into gas injection well 93.

After the tanks 82 on vessel 50 have been filled with live crude oil, the control and monitoring systems 56 on vessel 50 are then activated to send a signal, through cabling 54 and umbilicals 45, to shut off the flow of fluids from the wells 14 and/or to discontinue pumping of fluids from the wells 14. Cabling 54 and piping 53 on the vessel are disconnected to the umbilicals 45 and risers 41 by disconnection of piping 51 and cabling 55 with piping and cabling (not shown) in the mooring buoy 42. Vessel 50 thereafter is unattached from the mooring buoy 42 in a known manner. Vessel 50 then sails to a suitable onshore processing plant (not shown), where the vessel 50 is moored and the live crude oil in tanks 82 is transferred to the processing plant for subsequent processing. During sailing of vessel 50, gas from tanks 82 may be conveyed through pipe 84 to powered equipment, including the propulsion system, on vessel 50, to be used as a source of power for that equipment.

While the invention has been described in the specification and illustrated in the drawings with reference to preferred embodiments, it will be understood by those skilled in the art that various changes may be made and equivalents may be substituted for elements of the invention without departing from the scope of the claims.

What is claimed is:

1. An oil production system for off-shore use comprising:

an oil well, the oil well producing produced fluids;

a riser connected to the oil well;

a vessel, the vessel comprising at least one storage tank, the storage tank being selectively coupled to the riser, the at least one storage tank being capable of storing the produced fluids at a pressure in excess of 70 kPa gauge pressure;

a pipe connected to the storage tank, the pipe drawing off gas from the produced fluids; and powered equipment on the vessel, the pipe being connected to the powered equipment, gas from the produced fluids powering the powered equipment.

2. The system of claim 1, wherein:

the at least one storage tank being capable of storing the produced fluids at a pressure in excess of 1.8 MPa gauze pressure.

3. The system of claim 1, further comprising:

a pump, the pump being connected to the oil well, the pump increasing the pressure of the produced fluids.

4. The system of claim 1, further comprising:

a water injection well, a water injection riser, and a water pump.

5. The system of claim 1, further comprising:

means for drawing off gas from the produced fluids.

6. The system of claim 1, further comprising:

a gas injection well, a gas injection riser and a gas pump, the pipe injecting gas into the gas injection well through the gas injection riser.

7. The system of claim 5, wherein:

the vessel comprises powered equipment, and wherein the means for drawing off gas is connected to the powered equipment, gas from the produced fluids powering the powered equipment.

8. The system of claim 7, wherein:

the powered equipment is a propulsion system.

9. The system of claim 1, further comprising:

a mooring buoy, the riser being connected to the mooring buoy, the mooring buoy selectively coupling the storage tank to the riser.

10. The system of claim 1, wherein:

the vessel comprises a control system, the control system being selectively coupled to the oil well, the control system controlling flow of produced fluids from the oil well.

11. A method for producing crude oil offshore, comprising:

producing the crude oil from an oil well;

transferring the crude oil directly into at least one unpressurized storage tank on a vessel without further processing of the crude oil;

drawing off gas from the at least one storage tank; and using gas drawn off from the at least one storage tank to propel the vessel.

* * * * *

UNITED STATES PATENT AND TRADEMARK OFFICE

CERTIFICATE OF CORRECTION

PATENT NO. : 6,012,530

DATED : January 11, 2000

INVENTOR(S) : Jens Korsgaard

It is certified that error appears in the above-identified patent and that said Letters Patent is hereby corrected as shown below:

Column 3, line 6, change "relative" to --relatively--.

Column 4, line 2, change "may" to --may be --.

Column 5, line 44, before "steered" insert --is--.

Column 6, line 49, change "gauze" to --gauge--.

Signed and Sealed this

Tenth Day of April, 2001

*Attest:*

Nicholas P. Godici

NICHOLAS P. GODICI

*Attesting Officer*

*Acting Director of the United States Patent and Trademark Office*